US005924350A

United States Patent [19]

Helinski

[11] Patent Number: 5,924,350

[45] Date of Patent: Jul. 20, 1999

[54] HOLE PUNCHING APPARATUS

[75] Inventor: Edward F. Helinski, Johnson City, N.Y.

[73] Assignee: International Business Machines Corporation, Armonk, N.Y.

[21] Appl. No.: 08/937,410

[22] Filed: Sep. 25, 1997

[51] Int. Cl.[6] ..... B26B 7/00

[52] U.S. Cl. ..... 83/575; 83/588; 83/590

[58] Field of Search ..... 83/100, 365, 371, 83/402, 409, 588, 575, 590

[56] References Cited

U.S. PATENT DOCUMENTS 4,821,614 4/1989 Fleet et al. .
4,872,381 10/1989 Stroms .
5,079,983 1/1992 Bruhn .
5,140,879 8/1992 Haj-Ali-Ahmadi et al. .
5,222,012 6/1993 Frankeny et al. .
5,233,895 8/1993 Coneski et al. .
5,296,828 3/1994 Feinstein, Jr. et al. .
5,365,211 11/1994 Carbaugh, Jr. et al. ..... 83/171
5,410,233 4/1995 Carbaugh, Jr. et al. .

*Primary Examiner*—M. Rachuba
*Attorney, Agent, or Firm*—Ratner & Prestia; Lawrence R. Fraley

[57] ABSTRACT

Hole punching apparatus for punching holes in thin sheet material and having a punch mounted for reciprocating movement. The punch includes a punch stem, and an elastomeric bumper mounted on the punch stem. The bumper acts as a shock absorber when the punch is moved in a first direction to punch a hole in the thin sheet material and eliminates collision of metallic parts as the punch reaches the end of its stroke.

14 Claims, 1 Drawing Sheet

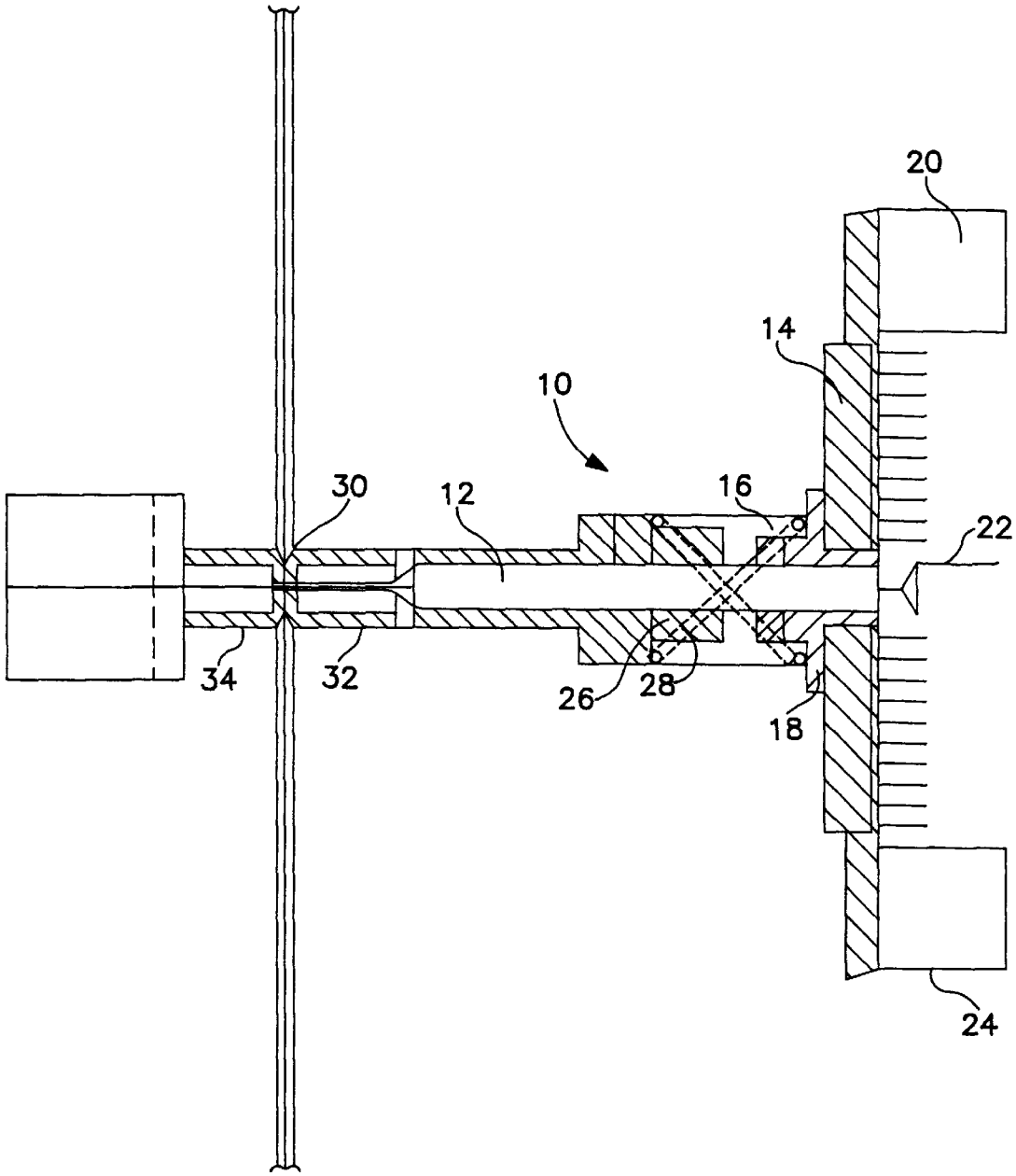
20
14
10
30
12
16
22
34
32
26
28
18
24

HOLE PUNCHING APPARATUS

TECHNICAL FIELD

The present invention relates to an automated punch apparatus for punching very small holes in thin sheet material and, more particularly, to an improved punch apparatus which allows for high speed punch operation.

BACKGROUND OF THE INVENTION

1. Field of the Invention

The present invention generally relates to the formation of holes in thin sheet material (e.g., Kapton web) by punching and, more particularly, to the monitoring and control of punching tools operated at high speed, especially as used in the fabrication of electronic circuit components.

2. Description of the Prior Art

The manufacture of many articles involves the formation of holes therein. In particular, it has been the common practice in the construction of electrical and electronic devices to mount components on a perforated insulating board or other substrate by passing leads through holes in the board. In such a case, connections are often formed by a conductive metal pattern on the board and also by wiring passed through the board through holes, or vias formed in the boards, as in constructions involving the well-known printed circuit.

The holes, or vias, are extremely small and very numerous. Therefore, the apertures which form the vias must be accurately positioned and must be of very accurate geometry. To achieve this accuracy, a punch is generally used to form the vias. A punch is also desirable because the material from the punched hole will be of a relatively large particle size in comparison with other methods which cut or erode material from the aperture.

A punch apparatus is very large in comparison to the holes formed in order to develop the force necessary to successfully and cleanly punch through the thin sheet material. In an automated punch tool operation, reliable and high rate punch actuation is desirable to permit high productivity and production rates.

In a typical punch, an electromagnetic repulsion actuator exerts a force on the punch propelling it through the thin sheet, thereby forming vias. A preloaded compression spring returns the punch to its original position. Because the majority of the energy of the actuator is stored in the spring during its actuation, only about 5% of the energy is used to punch the thin sheet material. This causes increased cycle time which can be reduced by applying more energy to the coil. Increased energy allows the punch to return more quickly to its original position.

However, if excess energy is applied to the coil, the spring will not stop the actuator motion, thereby causing the reciprocating portion of the punch to strike other portions of the punch structure at the ends of the punching stroke and elastically rebound therefrom. This rebounding causes wear debris to be formed due to metallic collision which could destroy the punch stem by bending and deforming or breaking it. The wear debris also causes frictional changes which can, in the most severe cases, bind the punch when the friction force exceeds the spring force and prevent the return of the punch. These frictional changes lead to changes in performance. The product of frictional drag force and the distance it acts over represents a loss of energy of the punch during actuation. The loss of energy increases cycle time of the punch and increases the time in which the punch stays in the material, thereby causing hole elongation when punching a fixed film with a moving die bar/punch actuator array. In most failures, variable degrees of hole elongation in the thin material precede punch sticking in the material.

These shortcomings and problems may be reduced or overcome with a net improvement in operating speed coupled with reduced occurrences of metallic collisions. U.S. Pat. No. 5,410,233 to Carbaugh et al. describes an electronic solution of energy absorption, whereby coil current is applied to decelerate the punch during its return in order to reduce metallic collision. However, this is an expensive and complex solution.

SUMMARY OF THE INVENTION

Hole punching apparatus, constructed in accordance with the present invention, includes a punch mounted for reciprocating movement. The punch has a punch stem, a conductive planar element mounted on the punch stem, and an elastomeric bumper mounted on the punch stem below the conductive planar element. The hole punching apparatus also includes a coil mounted in proximity to the planar element and means for energizing the coil to move the punch in a first direction. Additionally, the punching apparatus has a guide through which the punch stem moves positioned in the path of movement of the bumper. The guide limits the movement of the punch in the first direction and reverses the direction of movement of the punch upon contact with the bumper. Also, the hole punching apparatus includes a means for moving and positioning a thin sheet of material in the path of movement of the punch stem.

BRIEF DESCRIPTION OF THE DRAWING

The single FIGURE is a cross-sectional view of hole punching apparatus constructed in accordance with the present invention.

DETAILED DESCRIPTION OF THE INVENTION

Hole punching apparatus, constructed in accordance with the present invention, includes a punch 10 mounted for reciprocating movement. Punch 10 includes a punch stem 12, a conductive planar element 14 on the punch stem, and an elastomeric bumper 16 mounted on the punch stem below the conductive planar element. In the preferred embodiment, bumper 16 is friction fitted on punch stem 12 by a hole in the bumper through which the punch stem extends. Bumper 16 can be formed from polyurethane and, preferably, is disc shaped.

For the embodiment of the invention being described, punch 10 also includes a collar 18 mounted on the punch stem 12 between bumper 16 and conductive planar element 14.

Hole punching apparatus, constructed in accordance with the present invention, also includes a coil 20 mounted in proximity to planar element 14. Coil 20 is preferably a planar high energy coil through which a current flows to produce a magnetic field that links with conductive planar element 14, similar to the one disclosed in U.S. Pat. No. 4,821,614 to Fleet et al., which is hereby incorporated by reference for its teachings.

Hole punching apparatus, constructed in accordance with the present invention, further includes means for energizing coil 20 to move punch 10 in a first direction. Such means can be a suitable source of electric current connected to coil 20 by lead wires 22 and 24.

Hole punching apparatus, constructed in accordance with the present invention, further includes a guide 26 through which punch stem 12 moves. Guide 26 is in the path of movement of bumper 16 and limits movement of punch 10 in the first direction and reverses the direction of movement of the punch upon contact with the bumper.

For the embodiment of the invention being described, the hole punching apparatus further includes a spring 28 fitted between collar 18 and guide 26. Spring 28, in the form of a coil spring, surrounds guide 26, bumper 16 and collar 18 and urges punch 10 to its original position when the punch reverses direction after bumper 16 collides with guide 26.

Hole punching apparatus, constructed in accordance with the present invention, further includes means for moving and positioning a thin sheet material 30 in the path of movement of punch stem 12 between a guide block 32 and a punch die 34. Such means can be a carriage mounted on rails as disclosed in U.S. Pat. No. 4,821,614 to Fleet et al., hereby incorporated by reference for its teachings.

In operation, in the preferred embodiment described above, punch stem 12 is driven through the thin sheet material 30 by magneto repulsion acting on punch 10. A current, generated from a suitable source of electricity passes through leads 22 and 24 into coil 20. The current in coil 20 produces a magnetic field that links with conductive planar element 14 inducing a current that is substantially of opposite phase with the current flowing through the coil. The current in planar element 14 produces a magnetic field which opposes the field in coil 20. A force results from the two opposing magnetic fields which drives planar element 14 away from coil 20. The pulse of electrical current that passes through coil 20 is of a magnitude to produce a very rapid acceleration of the punch away from coil 20. The punch stem 12 is very rapidly accelerated initially, then the velocity remains constant until the point of rebound. The movement of punch 10 is terminated when the surface of bumper 16 strikes the surface of guide 26. Punch 10 is then rebounded. As punch 10 moves, coil spring 28 compresses and stores energy. When punch 10 rebounds, coil spring 28 returns punch 10 to its original position.

The inclusion of bumper 16, positioned between guide 26 and collar 18, avoids the problems that may be encountered as a result of metallic collisions that occur when excess energy is applied to punch 10 to decrease cycle time. These problems include the formation of wear debris and punch stem deformation. Bumper 16 acts as a shock absorber between collar 18 and guide 26. Additionally, bumper 16, upon colliding with guide 26, will compress under typical operating conditions and then will return about 50% of its initial energy in rebound energy. Much higher energy losses are encountered in the collision and rebound of metallic parts. Thus, with the inclusion of bumper 16, more energy can be supplied to the actuator without damage due to the slow deceleration of the bumper compared to the previous design with metallic collision. Furthermore, with the use of higher energy, frictional variations in energy are a much smaller percentage of the total energy available which improves the stability of operation and makes for a more robust design.

In sum, the improvements realized with the inclusion of bumper 16 in the punch apparatus are higher punch velocity, reduced stroke (the punch stem travels a reduced distance since the bumper terminates the stroke rather than the collar), less sensitivity to friction, reduced work engagement time, reduced wear debris, fast actuator cycle time, and greater reliability.

While this invention has been described with reference to specific embodiments, it is not necessarily limited thereto. Accordingly, the appended claims should be construed to encompass not only the form and embodiment of the invention specifically described above, but to such other forms and embodiments as may be devised by those skilled in the art without departing from its true spirit and scope.

What is claimed:

1. Hole punching apparatus comprising:

a punch mounted for reciprocating movement and including:

(a) a punch stem, (b) a conductive planar element mounted on said punch stem, (c) an elastomeric bumper mounted on said punch stem below said conductive planar element;

a coil mounted in proximity to said planar element;

means for energizing said coil to move said punch in a first direction;

a guide through which said punch stem moves in the path of movement of said bumper for limiting movement of said punch in the first direction and reversing the direction of movement of said punch upon contacting said bumper; and means for moving and positioning a thin sheet material in the path of movement of said punch stem.

2. Hole punching apparatus of claim 1 wherein said punch further includes a collar mounted on said punch stem between said bumper and said planar conductive element.

3. Hole punching apparatus of claim 2 further including a spring fitted between said collar and said guide for urging said punch to its original position.

4. Hole punching apparatus of claim 1 wherein said bumper is friction fitted on said punch stem by a hole in said bumper through which said punch stem extends.

5. Hole punching apparatus of claim 1 wherein said punch further includes a spring fitted between said conductive planar element and said guide.

6. Hole punching apparatus of claim 5 wherein said punch further includes a collar mounted on said punch stem between said bumper and said conductive planar element.

7. Hole punching apparatus of claim 4 wherein said bumper is disc shaped.

8. Hole punching apparatus of claim 6 wherein said bumper is polyurethane.

9. Hole punching apparatus of claim 5 wherein said bumper is friction fitted on said punch stem through a hole in said bumper.

10. Hole punching apparatus of claim 8 wherein said bumper is disc shaped.

11. Hole punching apparatus of claim 9 wherein said bumper is polyurethane.

12. The hole punching apparatus according to claim 1 wherein said elastomeric bumper absorbs energy of said punch moving in the first direction.

13. The hole punching apparatus according to claim 12 wherein said elastomeric bumper transfers approximately fifty percent of said energy of said punch moving in the first direction to the punch moving in the reversed direction.

14. The hole punching apparatus according to claim 1 wherein said elastomeric bumper compresses upon contacting said guide.

* * * * *